United States Patent [19]

Wesemann et al.

[11] Patent Number: 4,631,792

[45] Date of Patent: Dec. 30, 1986

[54] COMPOSITE BODY

[75] Inventors: Karl-Friedrich Wesemann, Mulheim; Rainer Lenk, Duisburg; Klaus Kobusch, Krefeld; Manfred Markan, Willich, all of Fed. Rep. of Germany

[73] Assignee: Mannesmann Aktiengesselschaft, Duesseldorf, Fed. Rep. of Germany

[21] Appl. No.: 524,768

[22] Filed: Aug. 19, 1983

[30] Foreign Application Priority Data

Aug. 20, 1982 [DE] Fed. Rep. of Germany ..... 3231433

[51] Int. Cl.[4] ..... B21B 31/08; B60B 7/06

[52] U.S. Cl. ..... 29/129; 29/129; 228/165

[58] Field of Search ..... 29/130, 121.4, 125, 29/127, 129; 228/165, 166, 168, 169

[56] References Cited

U.S. PATENT DOCUMENTS

| | | | |
|---|---|---|---|
| 375,352 | 12/1887 | Handloser | 29/125 |
| 1,816,307 | 7/1931 | Von Reis | 29/127 |
| 1,942,304 | 1/1934 | Mylting | 29/121.4 X |
| 2,364,983 | 12/1944 | Lagasse | 29/121.4 X |
| 3,526,939 | 9/1970 | Nikkanen | 29/129 |

FOREIGN PATENT DOCUMENTS

| | | | |
|---|---|---|---|
| 1302612 | 11/1962 | France | 165/170 |
| 1438943 | 7/1965 | France | 29/116 AD |
| 56-3159 | 1/1981 | Japan | 228/166 |
| 57-14090 | 9/1982 | Japan | 228/165 |

OTHER PUBLICATIONS

Modern Welding Technology, pp. 501-517, Prentice-Hall, Inc. Englewood Cliffs, N.J., 07632.

*Primary Examiner*—Howard N. Goldberg
*Assistant Examiner*—Timothy V. Eley
*Attorney, Agent, or Firm*—Ralf H. Siegemund

[57] ABSTRACT

A roll for the support and transport of ingots is disclosed including a core with a helical duct along the periphery covered by a thin sleeve being secured to the groove or duct separating ridges by welding making sure that coolant cannot flow transverse to the duct and that the sleeve cannot slip off the core. A particular welding technique as employed has broader applications including joining plate or sheet stock.

12 Claims, 3 Drawing Figures

COMPOSITE BODY

BACKGROUND OF THE INVENTION

The present invention relates to a roll for the support and/or transport of hot metal bodies, the roll being internally cooled and may be used, for example, in machines for continuous casting and here particularly for the support of the ingot as it is withdrawn from the mold on a continuous basis. The invention, however, as conceived on the basis of the particular objective, has broader applications and objectives accordingly, because the problem of improving such rolls led to the more general objective of combining two objects in a particular manner, whereby the purpose of the resulting combination entails particulars of and in the objects themselves and the mode and manner of affecting the combining must not only be compatible with the ultimate purpose of the composite object, but the chosen approach should avoid difficulties which may appear due to particular requirements of the result. Among these requirements are the separation of functions which the combined object is to carry out, but which different portions of the object should carry out in an independent, i.e., mutually noninterfering manner. This requirement in turn has led to procedures in the combining of two objects.

Internally cooled rolls for the purposes of transporting and/or supporting hot metal bodies such as ingots are known generally. They consist usually of a core or core-like structure with one or more channels being cut into the core surface. These channels or ducts merge with radial bores which, in turn, terminate in axially oriented bores traversing the journal pin or the like of the roll and by means of which the respective roll is journaled in the stand of the machine. The coolant is fed therefor axially into these journal pins and withdrawn therefrom for distribution throughout the roll, and here particularly the channel and duct system as outlined above. The core of the roll is clad in a sleeve which, for example, is shrunk upon the core thereby covering and closing the cooling channels and ducts.

During operation the roll may support a casting ingot having a temperature of up to and possibly exceeding 1200° C. It is quite clear that the more or less continuous exposure to such hot temperatures under severe load bearing conditions wears on the roll mechanically and/or thermally. It is also easy to understand that a roll being heated more or less continuously in spite of the cooling may be prone to sagging and may assume a distorted configuration. As far as the shrunk sleeve is concerned, it can readily be seen that this differential load on the roll as a whole may cause the sleeve to locally separte from the core. This in turn will lead to parasitic cooling paths so that for a given rate of coolant flow the desired and projected distribution of coolant may no longer may be assured. Therefore, it can readily be seen that in the case of a local separation of the sleeve from the core with a concommitant parasitic flow path there may well appear local areas in the roll which are no longer adequately cooled. This means that the local temperature of the roll in these insufficiently cooled areas may even higher so that any damage is reinforced by positive feed back action. Moreover, the roll serves in part as an object by means of which heat is removed from the object it transports. If now the temperature of the roll in local areas is insufficiently reduced cooling of the ingot engaging that spot will occur only to an insufficient degree. Aside from the detrimental effect of irregular cooling, one has to consider that high thermal differentials render the problem of mechanical loads under hot temperatures even more severe.

DESCRIPTION OF THE INVENTION

It is an object of the present invention to provide a new and improved roll for supporting and/or transporting hot objects such as ingots in a machine for continuous casting or the like under conditions which avoid the drawbacks outlined above and here particularly the composite effect of mechanical and thermal loads.

It is another object of the present invention to provide a new and improved transport and support roll which has improved bending stiffness is thermally stable and still provides adequate cooling of the object with which it is in contact. Herein, it is understood the term thermal stability is to mean not only resistance against a high, steady thermal load, but temporary excessive thermal loads and application of a thermal load in a nonuniform manner.

It is another object of the present invention to provide new and improved combining structure for two metal elements such as a roll core and a sleeve or two metal sheets or plates which ought to be combined in limited areas of contact only. It is a feature of the present invention to provide a new and improved composite body in which, for example, cooling and support functions can be separated to such an extent that there is little interference.

In accordance with the preferred embodiment of the present invention, it is suggested to construct a roll for supporting and/or transporting hot objects by providing a cylindrical core with journal pins and axial end ducts and with a groove or grooves along the periphery, preferably a helical groove, there being ridge means such as a helical ridge interposed and separating adjacent groove portions. A sleeve is placed on top of the core and covers the grooves to establish a duct, preferably a helical duct of wide cross-section, the width to height ratio being at least 5 to 1 preferably 8–10 to 1. The depth of the groove is about 10 percent of the radius of the core. The sleeve is fastened to the core at the ridges in a coolantproof, i.e., sealed manner preventing axial slippage of the sleeve of the core and particularly the ridge or ridges; therefore, the connection is such that even in the case of thermal wear and load, no cross passage between coolant duct portions and here particularly between adjacent channel or duct loops is possible. The connection between the core and the sleeve may be a threaded one or welded, whereby in one version the sleeve may have been a strip possibly a helical strip wound around the core in contact with the ridge or ridges and covering the groove trough or duct. The gap between adjoining strip portions are filled by welding thereby welding the strip to the ridge. In a preferred form, the sleeve is provided with an external groove being radially aligned with the ridge or ridges of the core so that thinned groove bottom portions of the sleeve sit on the projecting ridge or ridges of the core. Through welding this thin bottom is melted and fused to the ridge underneath and the remainder of the groove of the sleeve is filled with weld deposit material. This latter aspect has broader applications that two metal objects to be interconnected may be interconnected locally by providing one of the members, for example, with the groove and melting the bottom of the groove to the other member underneath pursuant to a first welding step which is then continued by filling the groove. The same principle can be applied to edge near weldings in that adjoining edges of sheet or plate stock are prepared in that one as a projecting ridge, the other one a matching groove. The ridge being thinner than the plates are thick, and through welding the ridge is melted and fused with the other sheet or plate; and beveling of the edges may establish a trough whose bottom is now closed and it can be filled with weld deposit to provide welding over the entire width of the sheet or plate stock.

DESCRIPTION OF THE DRAWINGS

Wihle the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIG. 1 illustrates a roll 1 having journal pins 3 and 4 in opposite axial ends. The particular roll is provided with mount covering sleeves. The roll includes a duct system for a coolant such as water and here particularly a helically configured coolant duct 2 with rectangular cross section looping around the axis of the roll at a certain small distance from the cylindrical periphery thereof. The end portions of this helical duct merge into channels 5 which in turn lead into an axial duct such as 3 or 4. The individual loops of the helical channel 2 are separated by a correspondingly helical bar or ridge 6 which in fact establishes a forced path for the coolant as symbolically illustrated by the dash-dot helical line 2'.

FIG. 1 illustrates a roll in a schematic fashion and for purposes of orientation has eliminated or avoided separation of the roll into a core and an outer sleeve structure. In fact, however, there is an outer sleeve which in toto establishes the radial outer boundary of helical duct 2.

Figure 1:
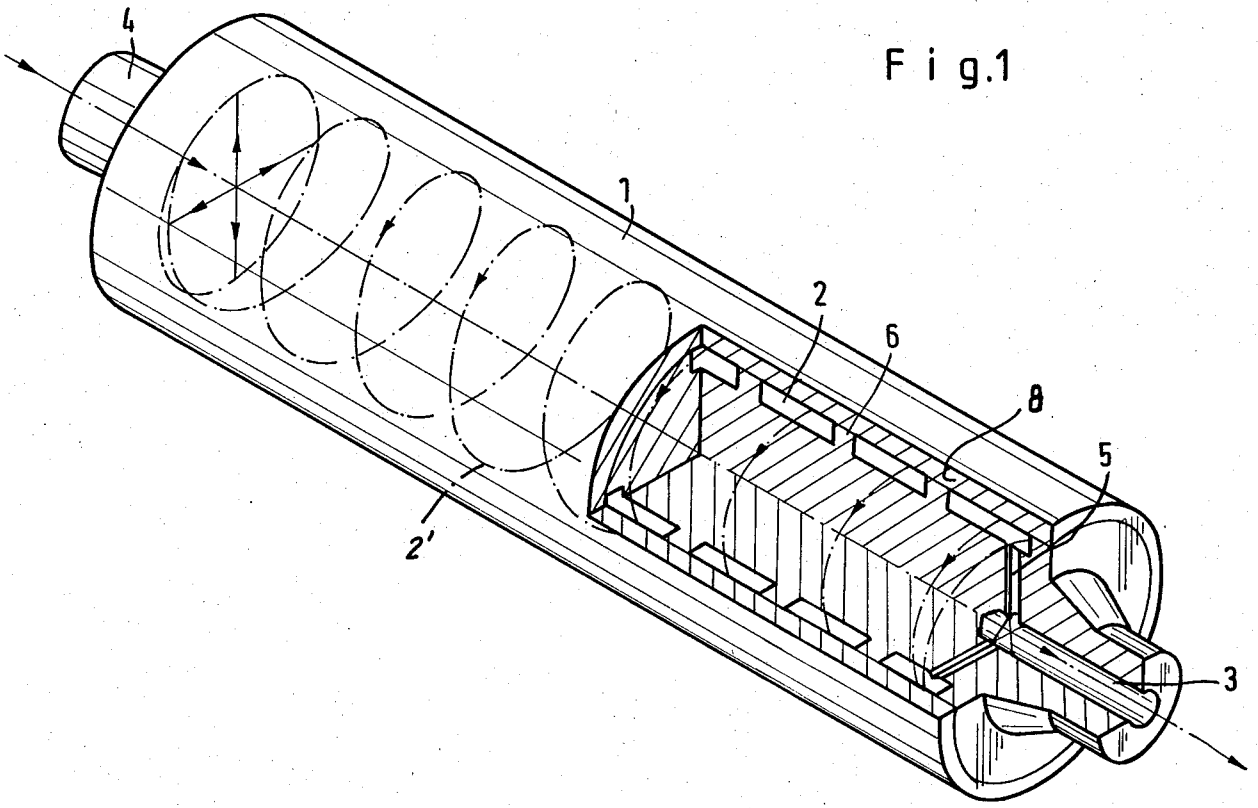
FIG. 1 is a perspective view partially cut open of a roll constructed in accordance with the preferred embodiment of the present invention for practicing the best method thereof.
Figure 2:
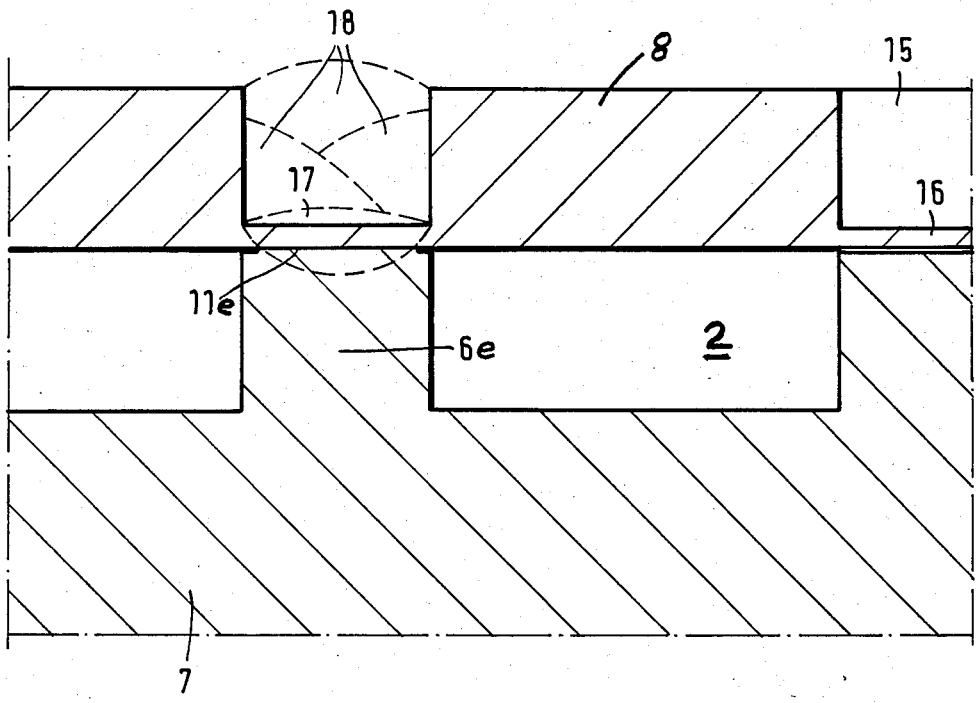
FIG. 2 is a cross section through the joint area between a core and a covering sleeve in a roll of the type shown in FIG. 1.

The FIGS. 2 now illustrate in detail the configuration of helical, channel-separating bar 6 with regard to its junction with an outer sleeve. Basically one can say that the core is provided as a more or less cylindrical drum on body 7, and that drum is provided with a helical rib such as 6. A sleeve 8 is put on top of the core and through a tight and sealed engagement with the top of the ridge 6 one establishes firm boundaries between the resulting helical channel. The sleeve 8 is affixed to the ridge 6 so that adjoining loops of the cooling duct 2 are sealed from each other as against lateral flow, and the sleeve 8 will not axially glide with respect to the core 7.

Figure 3:
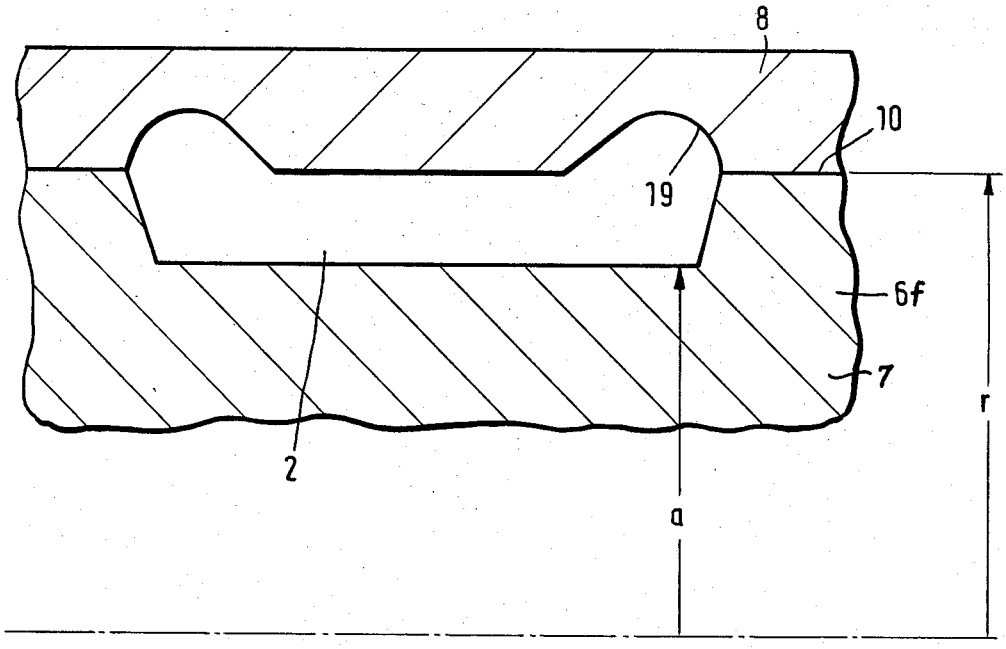
FIG. 3 is an enlarged view of the coolant duct in a longitudinally sectioned roll of the type illustrated in FIG. 2.

Broadly speaking, the coolant duct 2 should have a cross section which for a given area of flow maximizes the perimeter. This, of course, enhances the effective cooling of the sleeve which in turn enhances the cooling of the roll, as a whole, of the ingot with which the outer periphery of the sleeve is in contact. This in turn means that the area of contact between the coolant and the sleeve should be maximized. As far as the cross section of the cooling duct is concerned the boundary with the sleeve should be maximized, which is accomplished by chosing a pattern of cross-sectional dimensions of the cooling duct in which the interface with the sleeve has the widest dimension of the duct. These aspects are more fully developed in FIGS. 6 and 7 wherein FIG. 2 illustrates in a simple fashion that the cooling duct 2 is of rectangular configuration and the boundary with the sleeve 8 constitutes one long side of the rectangle. Further improvement is obtained as shown in FIG. 3 wherein the groove in the core, i.e., the space between ridges 6f is a trapezoidal trough and the sleeve 8 is provided additional surface enlargements 19. These indentations effectively enlarge the surface of contact between the fluid in the cooling duct and the sleeve. In addition, these indentations reduce the danger of notching and they reduce also internal tension in the sleeve. Basically, the indentations have a semi-circular configuration with linear transitions towards what becomes in fact the top of each cooling channel. Another general aspect of all the cooling channels as described thus far has to do with the depth of the channel. Herein it is proposed to provide a ratio between radius r of the drum shaped core measured at the perimeter of the ridges 6 - **6*a* - 6*b*** etc. to the radius a of the drum measured at the bottom of each cooling channel 2 to about 1:0.9. In other words the depth of the channel is about 10% of the radius of the core. Moreover, the width to height ratio in the channel should be at least 5:1, preferably 8 to 10:1.

Turning to further particulars of FIG. 2, it can be seen that the sleeve is provided here of tubular configuration but in which a helical groove 15 has been cut which is juxtaposed to the ridge such as ridge **6*e* on the core. The groove 15, however, does not separate the sleeve into a helical strip there being residual portions 16 which retains the tubular coherency of the sleeve. These bridges 16 therefor face the outer edge face 11e of the ridge 6*e***.

The purpose of these bridges 16 is to provide stabilizing coherency to these tubular sleeves 8 as a whole, thus facilitating its placement upon the core. Subsequently, the groove 15 is filled by welding and these bridges 16 are also instrumental in retaining the sleeve in a stable disposition and contour during the welding. Welding is carried and in any first welding step wherein the bridge 16 in fact melts; the melting process penetrates into the outer zone of the adjoining ridge **6*e* and provides a first welded connection 17 between the sleeve and the core. It is advisable though not necessary in in principle that subsequently additional weld deposits 18 are provided to fill the groove 15** in its entirety.

It can readily be seen that the inventive features produce a roll which on the basis of an assumed predetermined outer diameter is constructed for having the largest possible load bearing core diameter with the least possible sleeve thickness as a cover for the core. This then results in a high degree of mechanical resistivity and a particular high inherent resistance moment. The thermal load which the roll has to bear is essentially limited to the jacket defined by the sleeve. From a general point of view, one can see that this construction separates the two functions of the roll, namely support and cooling. This separation, in turn, reduces mutual interference in the two functions. The large resistance moment of the roll even if including the sleeve makes sure that even in the case of long-lasting one-sided heating of the surface of the sleeve, the roll will retain its dimensions because these dimensions are determined by the massive solid construction of the core and the surface near prevents penetration of heat into the interior of the core. The effective cooling supports therefor the function of the roll whereby particular a thin wall of the sleeve and a very accurately controlled guidance of water conduction provides a very effective removal of heat from the sleeve that is in contact with the ingot. Moreover, the construction is chosen so that particularly a high speed coolant is in heat exchange relationship with a thin-walled cool sleeve over what is in fact the largest possible surface area because the supporting ridges such as 6, etc. have to be only as wide as is necessary to take up the effective load between sleeve and core.

The invention and particularly the method as practiced is not limited to the manufacture of internally cooled rolls, but can be applied wherever weldable metal parts are to be interconnected only in limited and well-defined surface areas. This problem exists in mechanical equipment and container engineering. Limited surface areas are to be understood to refer to instances in which two bodies or components ought to be juxtaposed and mutually cover large surface areas but in which actual contact is limited to only a small portion of that surface. This means that areas exist which are supposed to be welded to each other but which are rather inaccessible or only insufficiently accessible for the welding process. The sleeve-core relation outlined above meets these constraints, but FIG. 2 shows how the problem can be dealt with. Other cases find elements, components such as plate stock or thick sheets adjoining along edges which is also a difficult problem with regards to welding.

The invention is not limited to the embodiments described above, but all changes and modifications thereof, not constituting departures from the spirit and scope of the invention are intended to be included.

We claim:

1. A composite body comprising a first metal element having a plurality of ridges delineating a surface plane; and a second metallic element having a surface situated in said surface plane, further having groove means on the side facing away from said surface plane, bottom portions of the groove means is fused with said ridge means.

2. A body as in claim 1, the remainder of the groove means being filled with weld deposit.

3. A composite body as in claim 1, wherein the first element is a cylindrical core the second element being a sleeve welded to the ridges which radially extend from the cylindrical core, the body constituting a cooled drum for the transport and/or support of hot objects.

4. A roll for supporting and/or transporting continuously cast objects comprising:

a core of cylindrical configuration having journal pins at its ends, there being a central duct in each of said journal pins, a shallow trough cut into the surface of the core in several adjoining loops there being relatively narrow ridge means separating the adjoining loops of the trough, there being duct means at the ends of the core interconnecting the trough with the central ducts in said journal pins;

a single sleeve on top of the core and covering the trough to establish a helical cooling duct of wide cross section, said sleeve being provided with groove means on its outside geometrically matching circumferentially the loops of the trough in radial alignment therewith, leaving looping, narrow bottom means directly adjacent said ridge means and also in radial alignment therewith; and means for providing a coolant tight and sealed connection between the sleeve and the ridge means for preventing also axial slippage between the sleeve and the core the connection including the entire bottom means fused to the ridge means as well as as weld deposits in the groove means of the sleeve.

5. A roll as in claim 4 wherein the respective portions of the sleeve covering the trough define the widest dimension of the cooling duct.

6. A roll as in claim 4 wherein the width to height ratio of the cooling duct is at least 5 to 1, preferably between 8 and 10 to 1.

7. A roll as in claim 4 wherein the depth of the trough is about 10% of the radius of the core.

8. A roll as in claim 4, said ridge having trapezoidal cross section.

9. A roll as in claim 4 wherein said sleeve is provided with a helical groove, the bottom of the groove being welded to ridge of the core, the ridge being correspondingly helical.

10. A composite body comprising:

a first metallic element; and a second metallic element interconnected by welding to the first metallic elment, the second metallic element having a reduced thickness adjacent a surface portion in contact with the first element, the reduced thickness portion fused with the first element.

11. A body as in claim 10, wherein the reduced thickness portion is a groove means being filled with weld deposit.

12. A body as in claim 10, the first element being a drum shaped core with radial ridge means, the second element being a sleeve having groove means, the groove means having a thin portion that is fused with the ridge means, the groove means being filled with weld deposit.

* * * * *